US006334711B1

(12) United States Patent
Risgalla et al.

(10) Patent No.: US 6,334,711 B1
(45) Date of Patent: Jan. 1, 2002

(54) LIQUID-TIGHT CONTAINER AND PROCESS FOR CONDITIONING A LIQUID IN SAID CONTAINER

(75) Inventors: Eric Risgalla, Prevessin-Moens; Xavier de Saint-Sauveur, Ferney-Voltaire, both of (FR)

(73) Assignee: Walk Pak Holding NV, Curacao (NL)

( * ) Notice: Subject to any disclaimer, the term of this patent is extended or adjusted under 35 U.S.C. 154(b) by 0 days.

(21) Appl. No.: 09/068,546

(22) Filed: May 15, 1998

Related U.S. Application Data

(63) Continuation of application No. PCT/IB96/01214, filed on Nov. 13, 1996.

(30) Foreign Application Priority Data

Nov. 16, 1995 (FR) ..... 95 13826
Aug. 29, 1996 (CH) ..... 2126/96

(51) Int. Cl.[7] ..... B65D 33/00

(52) U.S. Cl. ..... 383/205; 383/58; 426/85; 426/123

(58) Field of Search ..... 383/43, 58, 205; 206/218; 426/85, 123

(56) References Cited

U.S. PATENT DOCUMENTS 2,991,000 A * 7/1961 Spees ..... 383/205
3,051,209 A * 8/1962 Gonzalez ..... 383/58
3,197,119 A * 7/1965 Hartig et al. ..... 383/58
3,687,358 A 8/1972 Wink et al.
3,799,914 A * 3/1974 Schmit et al. ..... 426/85
4,411,359 A * 10/1983 Franco ..... 206/217
4,806,021 A * 2/1989 Koudstaal et al. ..... 383/906
4,811,848 A * 3/1989 Jud ..... 383/205
4,838,429 A * 6/1989 Fabisiewicz et al. ..... 383/205
5,425,583 A * 6/1995 Wild ..... 383/202
5,551,781 A * 9/1996 Wilkes et al. ..... 383/205
5,833,368 A * 11/1998 Kaufman ..... 383/205
5,836,697 A * 11/1998 Chiesa ..... 383/205
5,873,656 A * 2/1999 Arkins et al. ..... 383/202
5,997,177 A * 12/1999 Kaufman ..... 383/202

FOREIGN PATENT DOCUMENTS

FR 2 367 677 A 5/1978
GB 1021167 * 3/1966 ..... 383/58
GB 1 075 989 A 7/1967

* cited by examiner

*Primary Examiner*—Stephen P. Garbe
(74) *Attorney, Agent, or Firm*—Henderson & Sturm LLP

(57) ABSTRACT

This leaktight container includes four superimposed sheets (1, 2, 3, 4). The sheet (1) includes a precut tab (5) welded (13) to a portion of the sheet (2). A passage (10) is formed between these sheets (2) and (3) and acts as a valve between the inside and the outside of the leaktight container formed between the sheets (1, 4). A cut (9*a*) in the sheets (2, 3) allows the passage (10) to be placed in communication with the inside of the container formed between the sheets (1, 4). By pulling the tab (5) the wall of the passage (10) formed by the sheet (2) is torn and this passage is placed in communication with the outside.

9 Claims, 13 Drawing Sheets

LIQUID-TIGHT CONTAINER AND PROCESS FOR CONDITIONING A LIQUID IN SAID CONTAINER

This application claims is a continuation of application number PCT/IB96/01214, filed Nov. 13, 1996.

The present invention relates to a leaktight container for packaging a liquid, including a sheet fixed to the internal face of a wall of the container by a leaktight connection surrounding a region of this sheet thus isolating it from the inside of the container, the breaking of this sheet in the said region thus isolated allowing access to the inside of the container.

Such leaktight containers with more or less solid flexible walls, pierced with an opening which is sealed by a membrane fixed against its internal face, and used for the packaging of liquid are already known. To access the inside of the container, all that is required is for the membrane to be pierced. In general, when the liquid is a drink, the membrane is pierced using a drinking straw which is then used for sucking up the liquid. When the container is a flexible-walled bag in particular, the pressure required to pierce the membrane is transmitted to the wall of the bag, thus temporarily increasing the pressure on its liquid contents at the moment it is being opened, this meaning that the pressurized liquid can come out of the bag.

DE-A1-41 15 000 discloses a tubular bag in which the border parts adjacent to the longitudinal edges overlap, each of these edges being welded to the adjacent face. An opening is made in the border part of the underlying longitudinal edge, while a tab, which is offset with respect to the opening, is cut in the border part of the longitudinal edge covering this underlying part. A transverse weld extends between the two welded longitudinal edges. This transverse weld passes between the opening and the tab, so that a leaktight barrier isolates this opening from the cut out tab. To open the bag, it is merely necessary to pull on this tab so as to tear that portion of the wall of the bag which covers the opening.

To access the opening, the transverse weld which separates the opening from the tab must first of all be broken by pulling this tab. This breaking of this transverse weld requires substantial effort. It is also difficult to control. This means that there is a risk of it's either causing the tab to break, or of the longitudinal welds becoming torn, causing the bag to fall apart. Independently of these risks, the leaktight overlap region in which the opening is located, situated between the longitudinal welds, the transverse weld and a weld sealing one end of the bag, is in communication with the inside of the bag. This means that liquid can enter this region. As the bag is being opened, this liquid may run out over the external face of the bag and dirty it.

Leaktight bags are also known which have a valve, at least part of which is situated inside the bag and is formed between two flexible sheets passing through part of the bag and fixed in leaktight fashion between the edges of the bag. These sheets are joined together along two lines which do not converge so that by moving the said sheets away from one another a passage is formed between these lines, allowing a fluid to pass from the inside to the outside of the bag, the flexible sheets being intended to be pressed one against the other as soon as a force for parting them is no longer applied to them, thus preventing the said fluid from coming out of the bag.

Such bags are known and have been described in WO 985/23742, in FR 2 711 115 or in FR 1 338 549 in particular.

The valve of these leaktight bags is normally formed by a passage which is open at both of its ends which means that it offers the user no guarantee regarding use of this bag prior to its purchase. Aside from the fact that the purchaser therefore has no guarantee that the bag still contains the initially packaged amount of product, neither does he have any guarantee regarding the conditions of hygiene of the product thus packaged.

To overcome this drawback, it has been proposed to seal one of the ends of the passage using an attached cap, thus requiring another component to be added to the packaging.

To work effectively, the passage forming the valve between the two flexible sheets has to be long enough to provide an effective seal. In the solutions proposed hitherto, the length of the passage has been increased by forming a passage which is at an angle to the major axis of the bag, which means that the length of this passage is increased without a proportionate increase in the length of the flexible sheets extending into the bag. All the same, the surface area of flexible sheet used is substantially greater than the surface area occupied by the passage.

In addition to optimum usage of the sheet material forming the valve, one of the objects of the present invention is optimum usage of the volume of the bag. In bags of the state of the art, the top of the bag is left open to allow for filling. The fill level cannot be very high in such cases otherwise the liquid overflows from the bag when the top edge is welded up. This means that the extent to which the liquid fills the bag is not very high. Of course it is possible to fill the bag through the passage of the valve, but liquid would remain in this passage, and this would not be acceptable as the passage has to remain perfectly clean until it is first used.

The object of the present invention is to overcome, at least in part, the aforementioned drawbacks.

To this end, the subject of the present invention is a leaktight container in which a tab, intended for opening the said container, is formed in the portion of its wall adjacent to a region of the sheet fixed to the inside of the container, surrounded by a leaktight connection attaching this sheet to the wall of the container, one end of this tab being free and acting as a means for holding, while another part of this tab is fixed to the said sheet, thus allowing the said sheet to be broken by pulling on the tab and thus gaining access to the inside of the container.

Another subject of this invention is a leaktight bag of the aforementioned type, fitted with a valve. To this end, a second flexible sheet is joined to the first sheet, which is also flexible, along two connection lines which do not converge extending between two distant parts of the joined-together edges of the walls of the container to form a passage between these sheets in the part extending between the connection lines, at least one of the said sheets having a cut between the said non-converging connection lines, some distance from the said leaktight connection between the said first sheet and the wall of the container so as to make the said passage communicate with the inside of the container, the parts of these sheets situated between the said connection lines being intended to be pressed one against the other as soon as a force for parting them is no longer applied to them, thus preventing the said fluid from coming out of the container after an opening has been made in the said first sheet using the said tab.

Another subject of the invention is a bag or a leaktight container of the aforementioned type, fitted with a valve, in which bag or container a second passage is formed between the said flexible sheets and has an outer end adjacent to one edge of the said bag and the other end in communication with the inside of this bag.

Another subject of this invention is a method for packaging a liquid in a bag or container including the said second passage, according to which method the bag together with the two passages is formed, at least the outer end of the said second passage adjacent to the edge of the said bag is left open, the said liquid is introduced through this second passage and the said outer end of the second passage is sealed.

Among the many advantages of the container which forms the subject of the present invention, in the case of a valveless container, apart from the fact that it overcomes the risk of liquid under pressure leaking out as this container is being opened, the solution proposed does not add any additional components to the leaktight container as compared with the known solutions, the tab being formed by a portion of the wall of the container. This solution therefore does not lead to an increase in production costs. Furthermore, existing production lines can continue to be used with only very slight modifications affording an advantage which is not insignificant from the product standpoint.

In the container with a valve, the valve is protected from any attempts at tampering. Hygienic conditions are perfectly guaranteed right up to the first time that the bag is used. The number of components forming the bag and the valve are reduced as far as possible, no attached element being needed to tamperproof the valve. The area of sheet needed to produce the passage and the fillable volume of the bag is optimized.

Other advantages will emerge from reading the description which follows, given with the aid of the appended drawing which illustrates, diagrammatically and by way of example, one embodiment and various alternative forms of the leaktight container which forms the subject of this invention.

Figure 1:
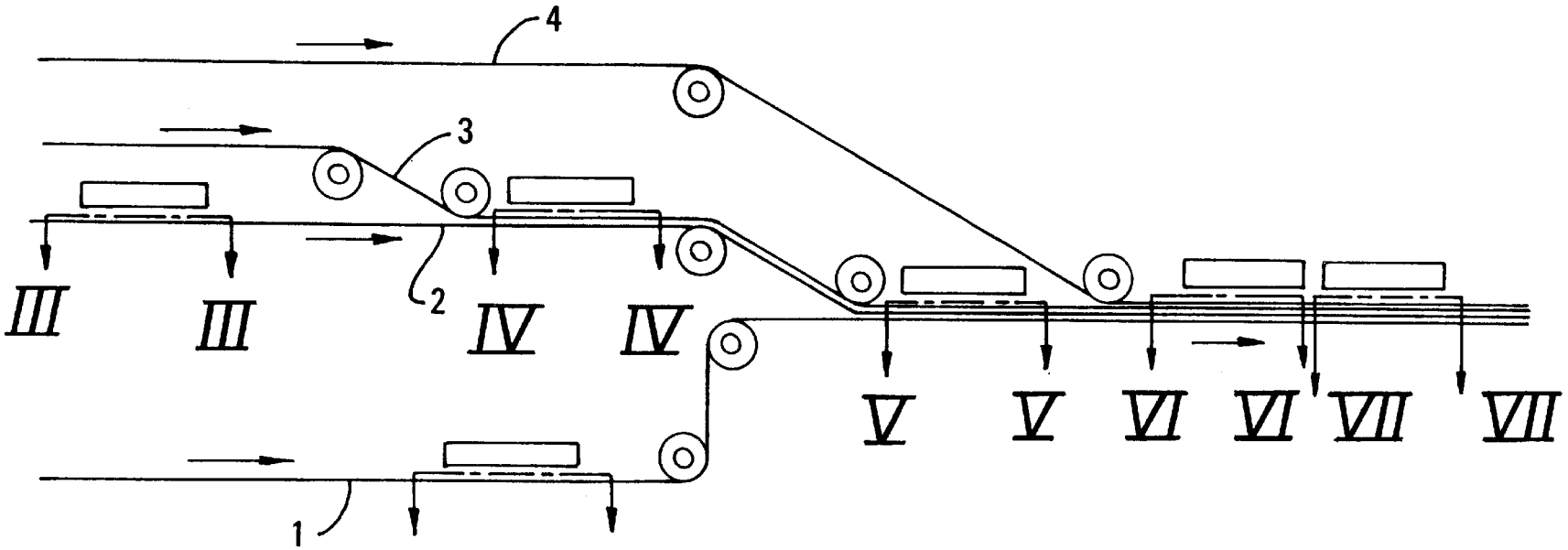
FIG. 1 is an elevation illustrating the various stages in the process for manufacturing this leaktight container.
Figure 2:
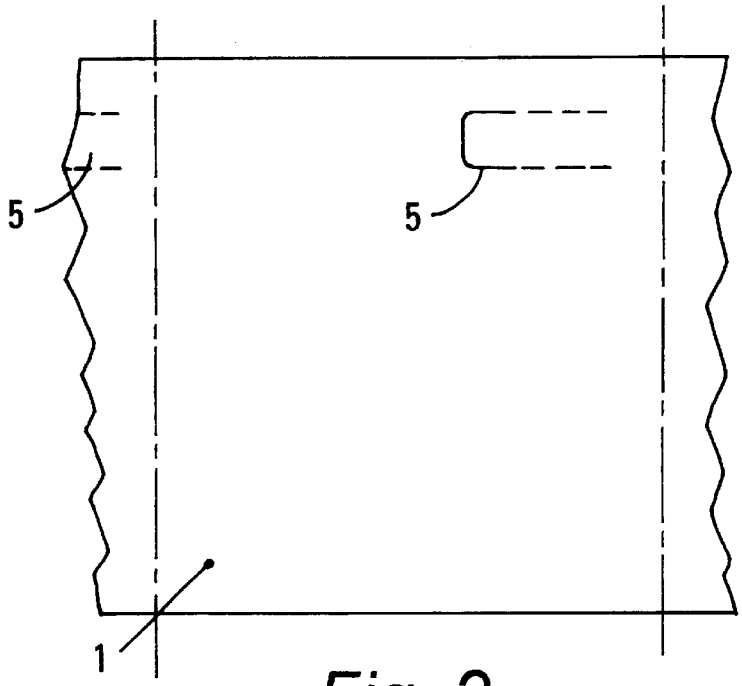
FIG. 2 is a plan view on II—II of FIG. 1.
Figure 3:
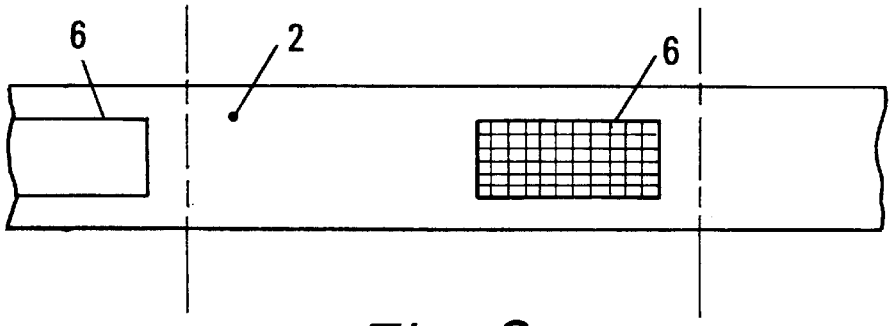
FIG. 3 is a plan view on III—III of FIG. 1.
Figure 4:
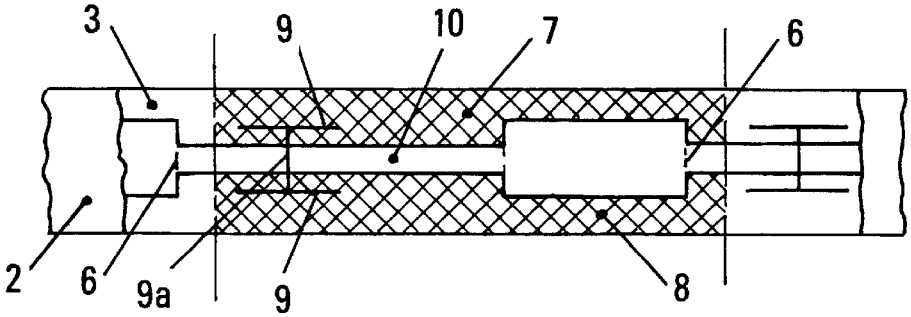
FIG. 4 is a plan view on IV—IV of FIG. 1.

FIG. 1 illustrates four endless strips 1, 2, 3, 4 of monolayer or multilayer thermoplastic film, such as polystyrene, polypropylene, polyethylene or polyamide, which are used to manufacture the leaktight bag which is the subject of the invention. The strips 1 and 4, which are wider, are intended to form the walls of the bag, while the narrow strips 2 and 3 are used to produce the valve. As a preference, the thickness of the film of the strips 2 and 3, which is of the order of 40 $\mu$m, is less than that of the film of the strips 1 and 4, which is of the order of 100 $\mu$m, so as to make the strips 2 and 3 more flexible, to make it easier for the valve to close.

The various operations in manufacturing this bag progress in line on the strips 1 to 4 and are illustrated by FIGS. 2 to 7 in which the width of the bag is drawn in chain line.

The first operation is carried out on the sheet 1 and consists in precutting tabs 5 at regular spacings. Each tab 5 is intended to be situated close to one of the corners of the bag. The end of this tab 5 is cut out, while its parallel edges are precut in such a way that before use the tab 5 remains in the plane of the sheet 1.

The second operation (FIG. 3), consists of depositing a rectangle 6 of heat-resistant ink or lacquer on the sheet 2, at regular spacings, corresponding to the spacings between the tabs 5.

The third operation consists of welding the sheets 2 and 3 along two parallel lines 7 and 8 (FIG. 4), leaving a passage 10 between them, the flexible walls of which passage are normally touching, but can be moved apart, thus forming the valve which controls the dispensing of the packaged liquid. These welds 7 and 8 narrow at the point where the heat-resistant lacquer 6 is situated. During the same operation, two parallel cuts 9 are made in the welds 7 and 8, and a transverse cut 9*a* connects the parallel cuts 9, thus placing the passage 10 in communication with the outside.

During the fourth operation (FIG. 5), the two strips 2 and 3 are welded to the strip 1 with a weld 11 which extends along the outer edge of the strips 2 and 3 and near to the adjacent edge of the strip 1. A weld 12 is also produced. The welds 11 and 12 are disposed on both long sides of the rectangle 6 of heat-resistant lacquer deposited on the sheet 2 and the weld 12 cuts across the width of this rectangle 6 so that the sheets 2 and 3 are not welded together at the location of the passage 10. A weld 13, in the shape of a rectangle, superimposed on the rectangle 6 of heat-resistant lacquer is also produced so that only the sheets 1 and 2 are welded together at the location of this rectangle 13.

Next, in the next stage, the strips 1, 2, 3 are covered with the fourth strip 4 and three welds 14*a*, 14*b*, 14*c*, forming three sides of the leaktight bag 15 are formed, one of them, 14*b*, along one of the edges of the strips 1 and 4, and the other two, 14*a*, 14*c*, transversely to these strips. The fourth side, adjacent to the other edge of the strips 1 and 4, remains open to allow subsequent filling of the leaktight bag 15.

The last step consists in detaching the leaktight bags from one another between two adjacent welds 14*a*, 14*c*.

Figure 7:
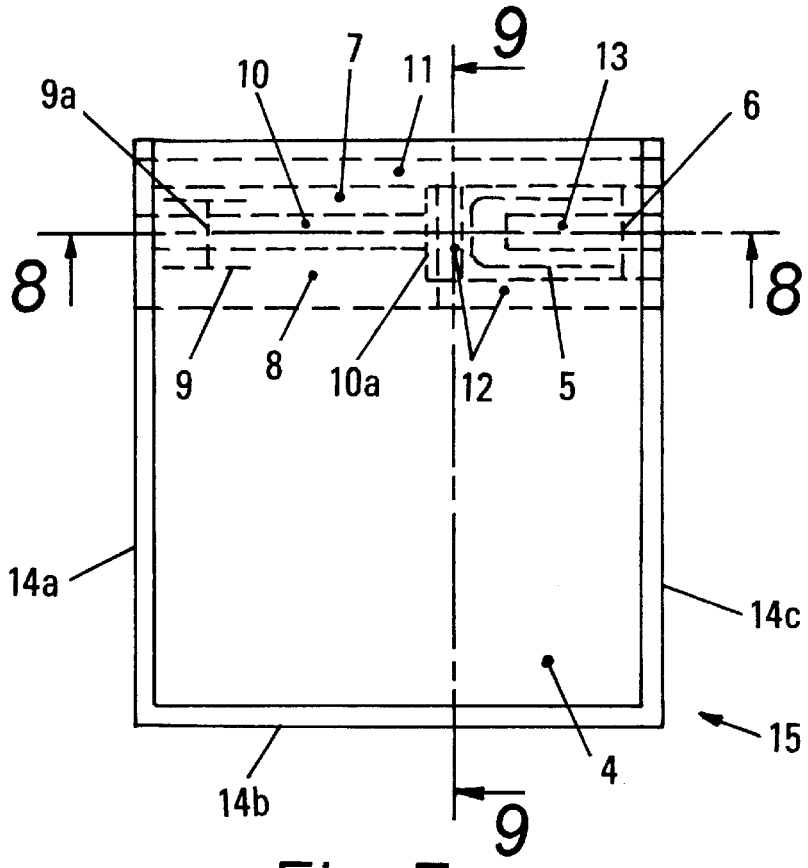
FIG. 7 is a plan view on VII—VII of FIG. 1.
Figure 8:
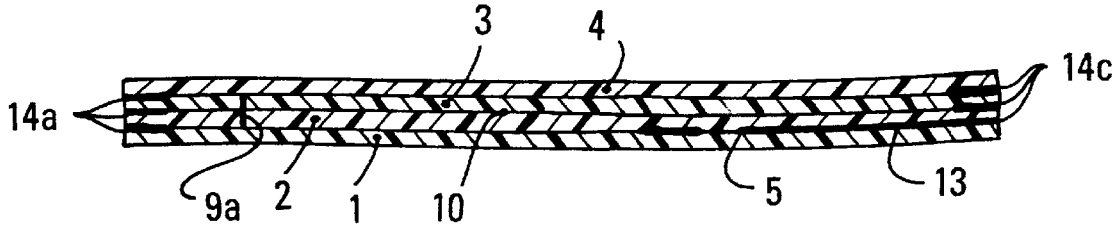
FIG. 8 is a section on VIII—VIII of FIG. 7.
Figure 9:
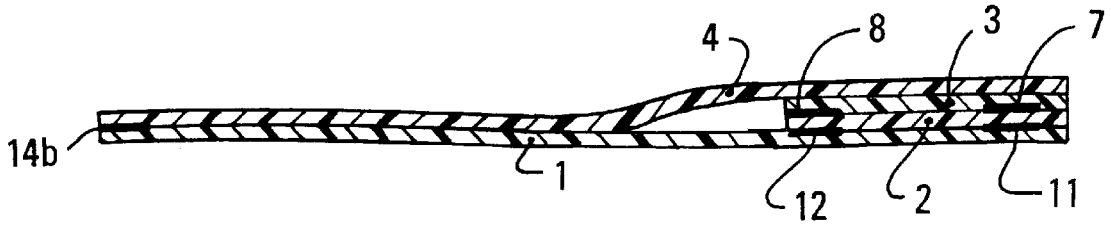
FIG. 9 is a section on IX—IX of FIG. 7.

The leaktight bag 15 illustrated in FIG. 7 is ready to receive the liquid to be packaged, after which the fourth side will be welded up, enclosing the liquid in a leaktight way.

The contents of such a bag cannot be consumed straight from the hermetically-sealed bag after the bag illustrated in FIG. 7 has been filled. This is because there is no opening giving access to the inside of the leaktight bag, which means that this bag is guaranteed tamperproof and any tampering can be verified, and that hygienic packaging conditions are ensured insofar as there is no opening giving access to the inside of the bag.

Figure 10:
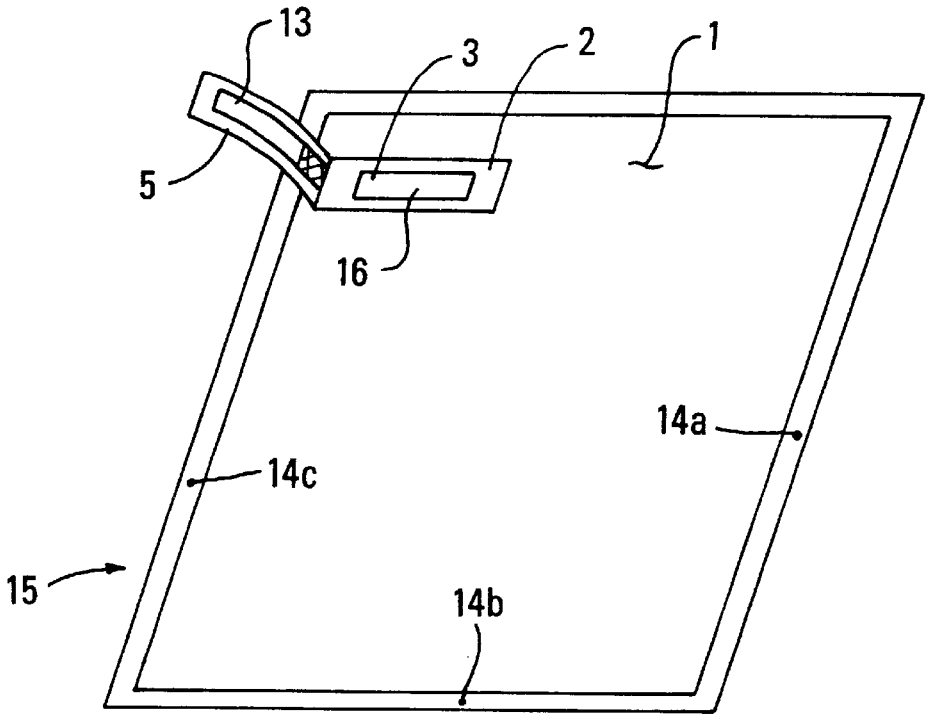
FIGS. 10, 11 and 12 are perspective views of a leaktight bag illustrating three stages in its use.
Figure 11:
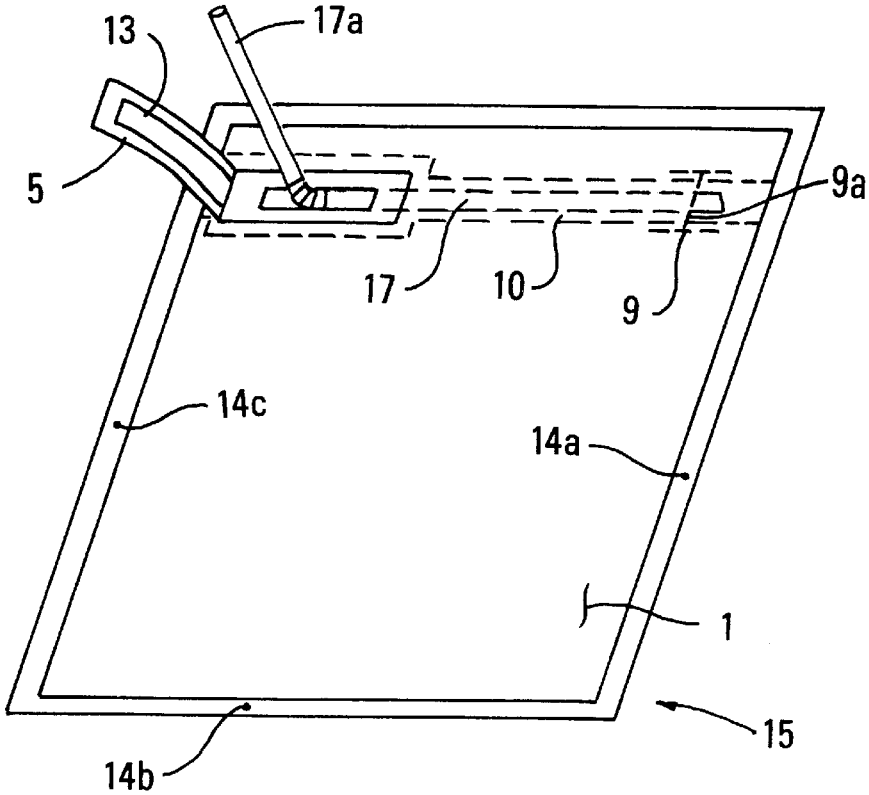
Figure 12:
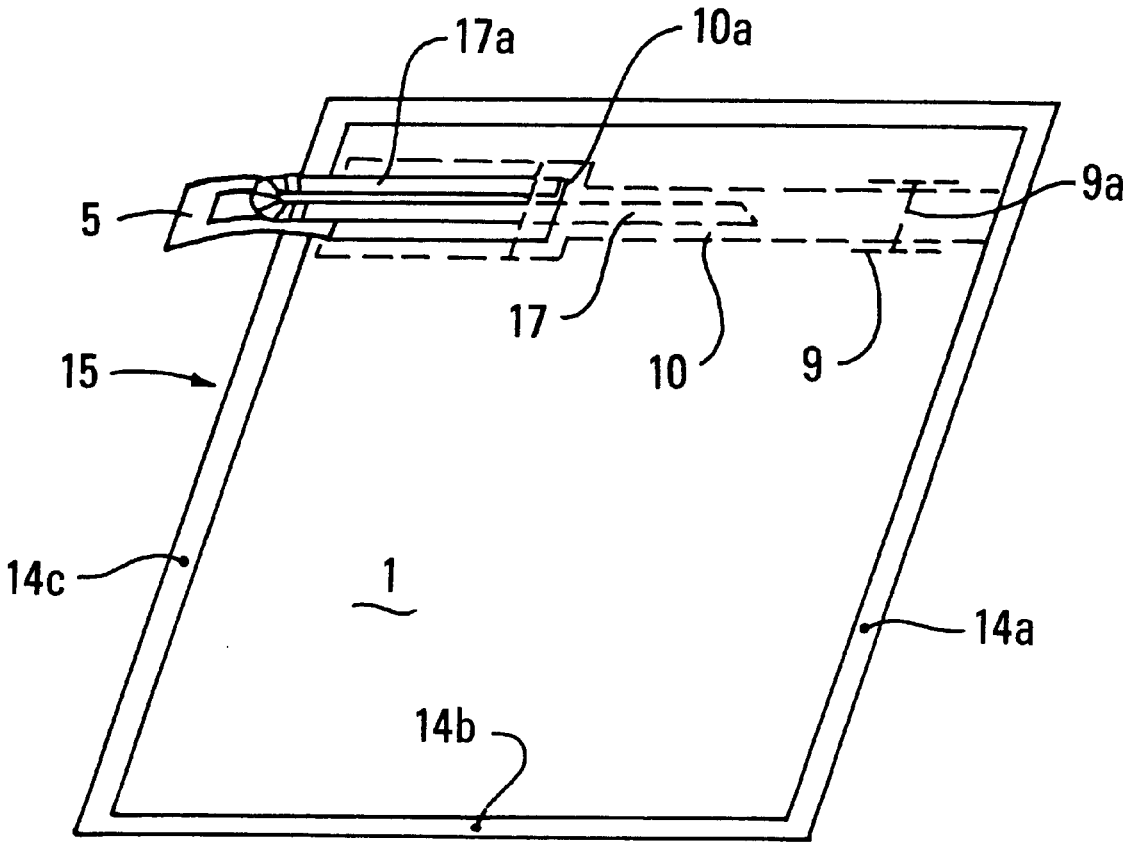

FIGS. 10 to 12 show how it is possible to access the contents of the bag using a drinking straw or some sort of passage 17 allowing the liquid to pass from the inside to the outside. All that is required is for the tab 5 to be lifted and pulled towards the edge 14*c* of the bag 15. Given that the tab 5 is welded along the weld rectangle 13 to the strip 2 which forms one of the walls of the passage 10, by pulling it, this wall 2 is torn thus making an opening 16 in the passage 10. This opening 16 allows a tubular element 17 such as a drinking straw or pouring device to be inserted. This tubular element 17 has to be long enough to emerge from the cut end 9*a* of the passage 10, thus placing the contents of the leaktight bag in communication with the outside.

To interrupt this communication before all the liquid contained in the bag has been used up, all that is required is for the drinking straw 17 to be withdrawn so that its end becomes set back by a certain distance from the cut end 9*a* of the passage 10. As a preference, as illustrated in FIGS. 7 and 12, the start of the passage 10 has a sudden widening 10*a* intended to allow a folded-back end 17*a* of the drinking straw 17 to be housed and kept in place when one wishes to stop consuming the liquid. The end of the widening 10*a* also forms a stop for the folded over end 17*a* of the drinking straw 17, preventing this drinking straw from being pushed so far into the passage 10 that it would open the valve formed by this passage 10. As can be seen in FIGS. 10 to 12, the edge of the tab 5 attached to the wall 1 of the leaktight bag 15 is adjacent to the weld 14*c,* which means that this weld limits the amount by which the tab 5 can be pulled back.

Figure 5:
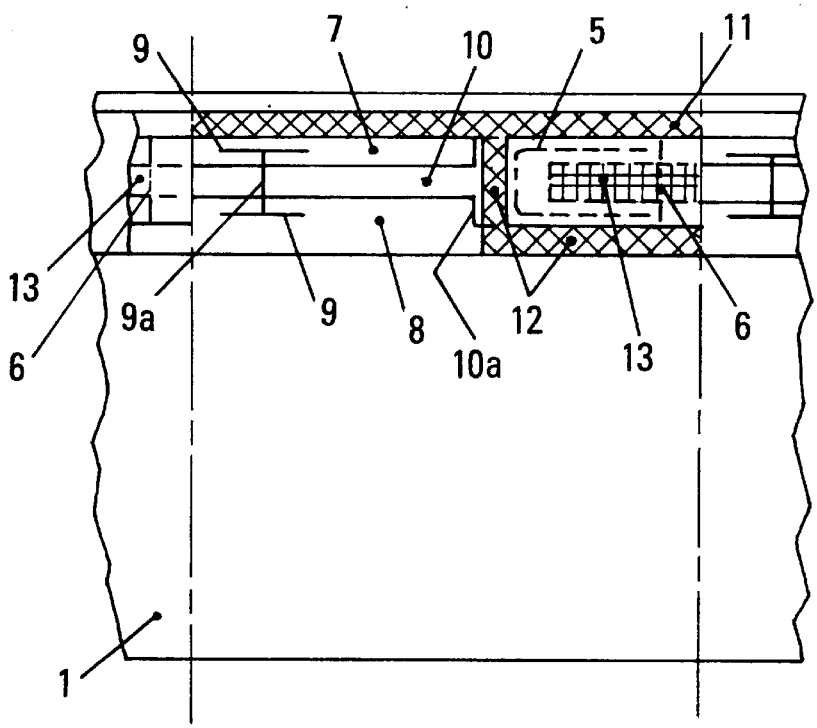
FIG. 5 is a plan view on V—V of FIG. 1.
Figure 6:
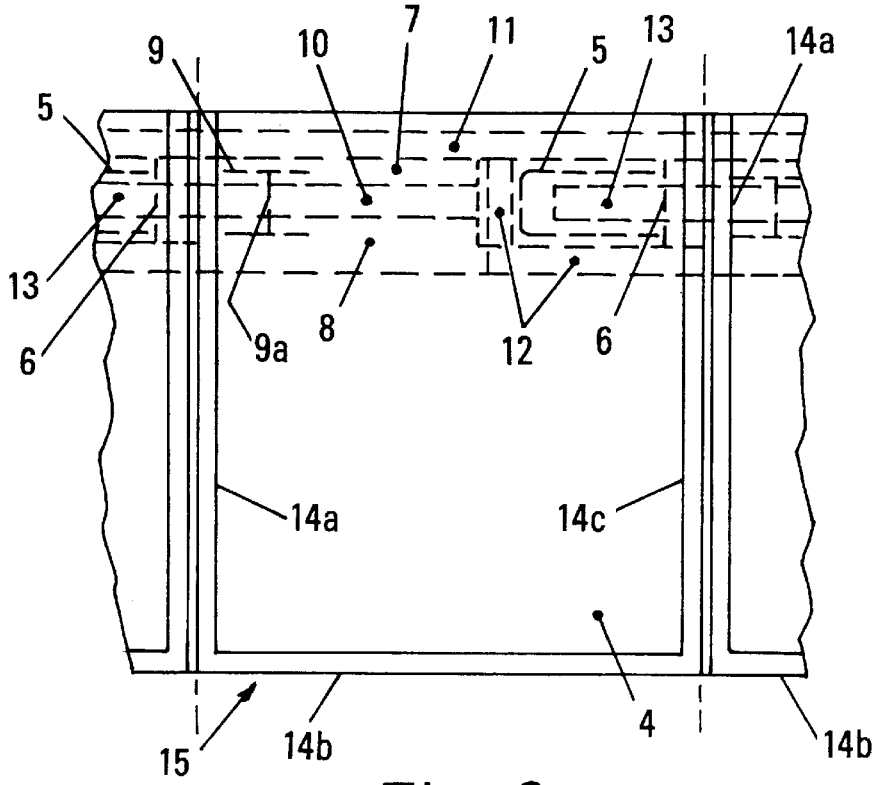
FIG. 6 is a plan view on VI—VI of FIG. 1.
Figure 13:
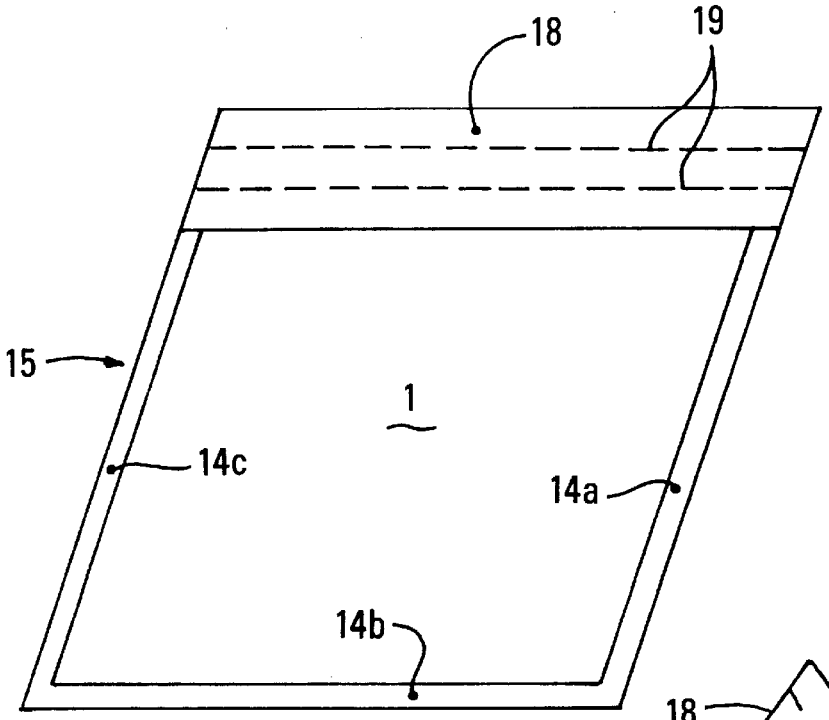
FIGS. 13 to 15 are perspective views of an alternative form, illustrating three stages in its use.
Figure 14:
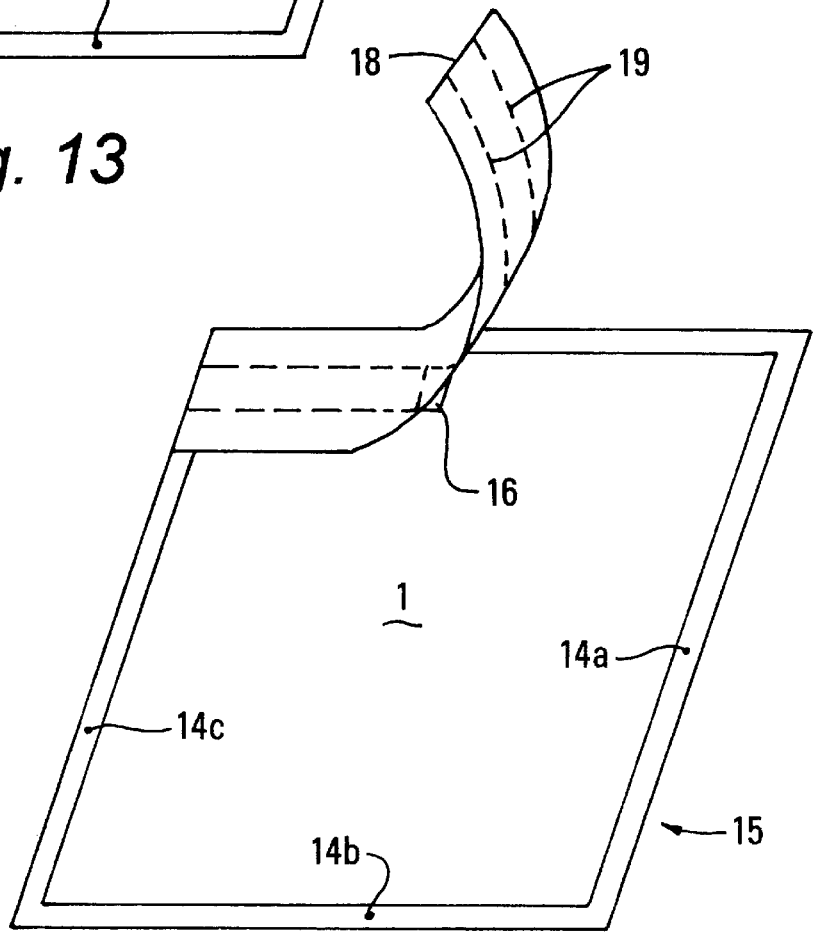
Figure 15:
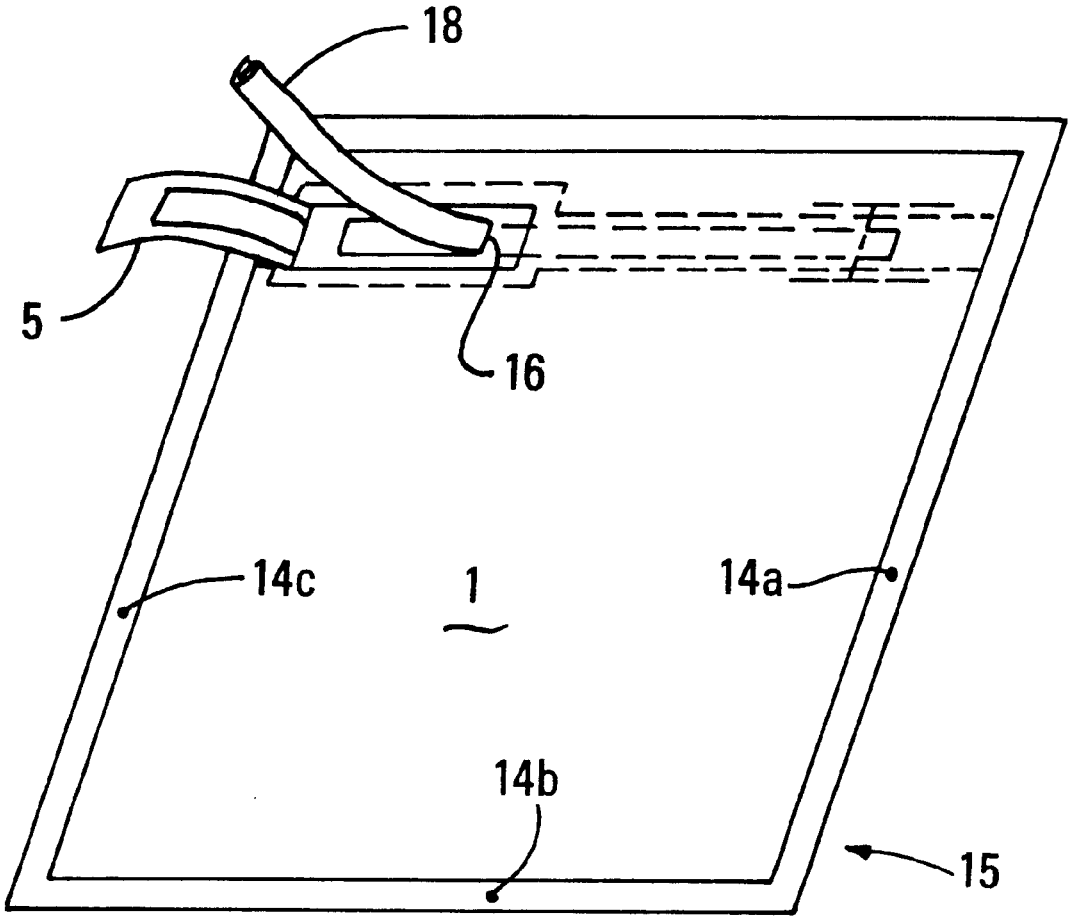
Figure 16:
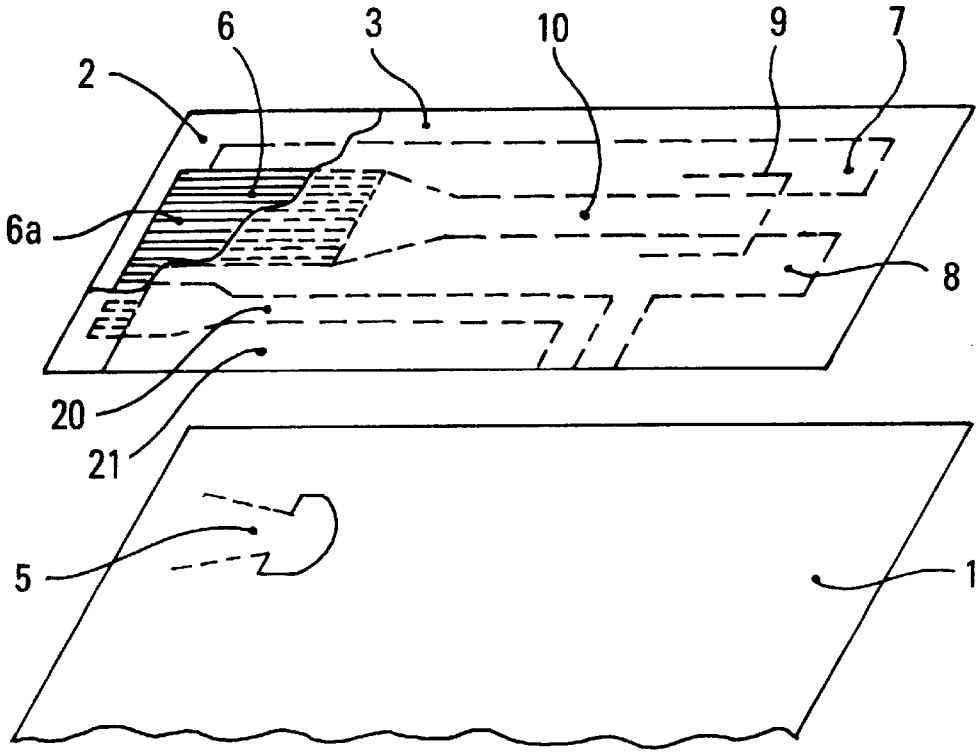
FIGS. 16 to 19 illustrate various phases in the production of an alternative form of the container forming the subject of the invention.
Figure 17:
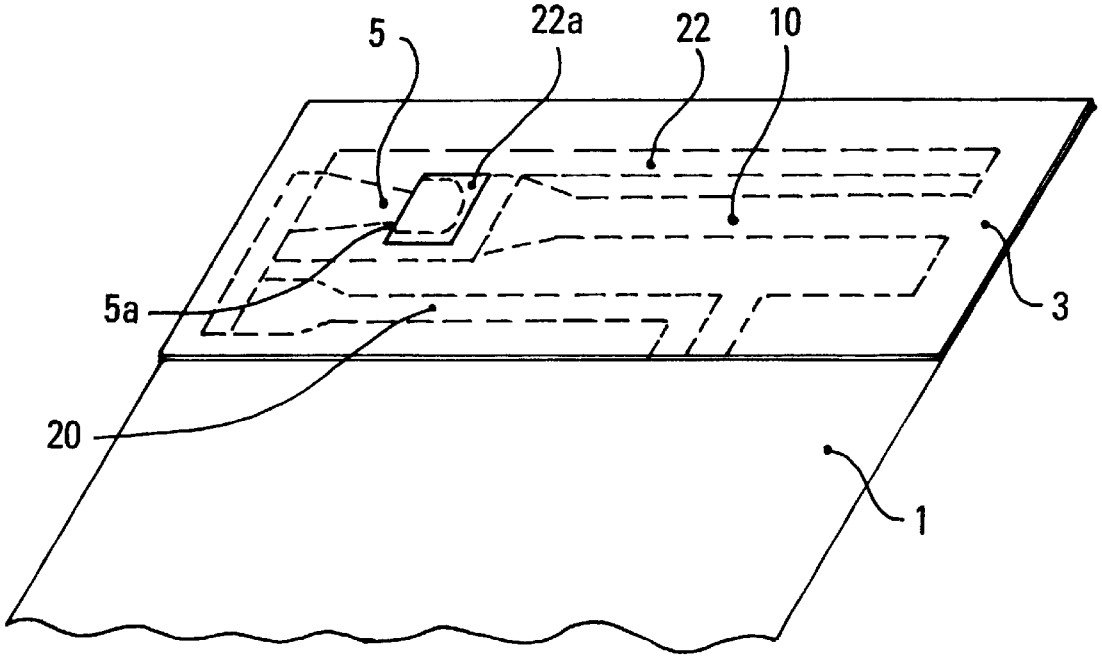
Figure 18:
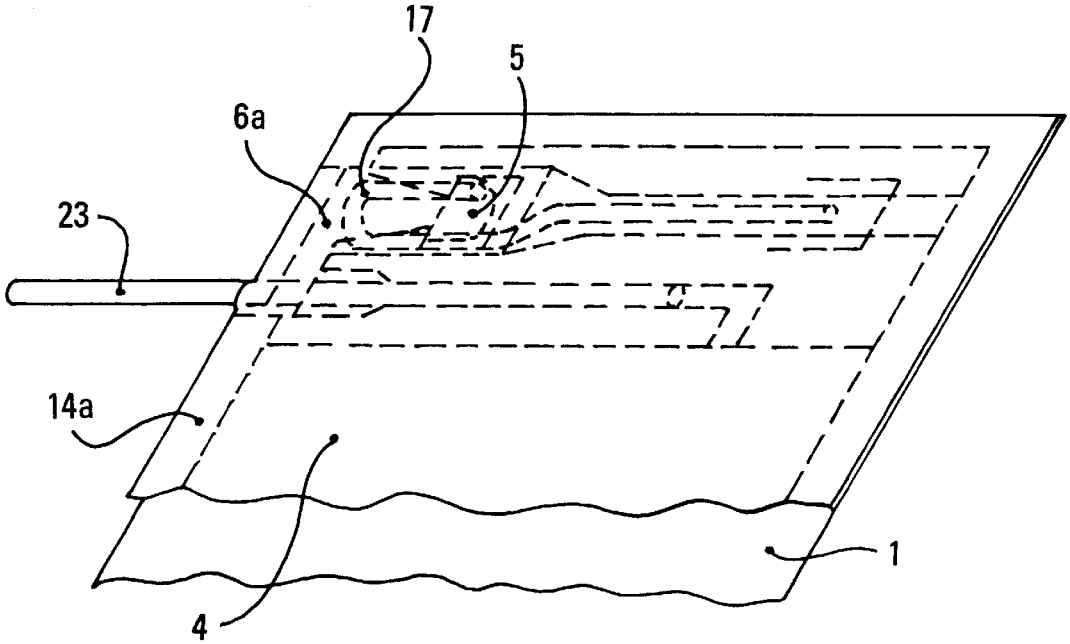

The alternative form illustrated by FIGS. 13 to 15 consists in adding to that part of the bag 15 which is fitted with the valve, a strip of a more rigid material, such as a strip of thicker material (of the order of 200–250 $\mu$m) 18, such as a thermoplastic film of the same type as that used for the sheets 1 to 4. This strip 18 has parallel score lines 19 which are obtained by compression. This strip 18 is fixed to the bag by welding it to the tab 5, itself welded around the rectangle 13 to the sheet 2, as illustrated in FIGS. 5 to 7.

By pulling on the strip 18, the tab 5 is first uncovered by strip 18 and then pulled and the wall of the passage 10 is torn, thus opening the valve. The strip 18 is then detached from the tab 5, the weld between this strip 18 and this tab being chosen to offer lower resistance to pulling than the weld 13 between the tab 5 and the sheet 2. Once the strip 18 has been detached, it is bent along the score lines 19 to form a pipe which acts either as a drinking straw or as a pouring spout depending on the shape it has, and it is inserted into the opening 16 as before (FIG. 15).

The alternative form illustrated by FIGS. 16 to 19 shows, in addition to the passage 10 which acts as a valve and as a pipe for dispensing the liquid packaged in the bag, a passage 20 intended only for filling the bag.

The operations in manufacturing the bag according to this alternative form are the same as those described in respect of the previous embodiment, which means that these operations will be described more briefly for this alternative form.

As before, the opening tab 5 is precut in the sheet 1 used to form one of the walls of the bag. In parallel, a layer of sparing lacquer 6 is deposited on one 2 of the sheets, the one intended to form the valve. As is visible in FIGS. 16 to 19, the layer of sparing lacquer 6 also extends over some 6*a* of the width of the weld 14*a* forming the perimeter of the bag, and over a certain length of this weld 14*a,* for the reason which will be explained later.

Next, the sheets 2 and 3 are welded along the line 7, 8 to form the passage 10, and the cut 9 is made to place this passage in communication with the inside of the bag. As far as the passage 20 is concerned, it is formed between the weld 8 and a weld 21 which extends along the inner edge of the sheets 1 and 2.

Once the passages 10 and 20 have been formed, the sheets 2 and 3 are joined to the sheet 1 using a weld 22 (FIG. 17) which has an opening 22*a* superimposed with the head 5*a* of the tab 5. This weld, as before, joins the rest of the tab 5 to the wall 1 of the bag, the sparing lacquer 6 preventing the two walls 2 and 3 from being welded together at the location of the passage 10 between them.

At this stage (FIG. 18) the sheet 4 is superimposed on the sheets 1, 2 and 3 and they are welded edge to edge to form the leaktight bag. During this operation, it is contrived for the welding of the edge of the bag to be superimposed with the region 6*a* covered with sparing lacquer, which has the effect of leaving this part of the bag open.

Figure 19:
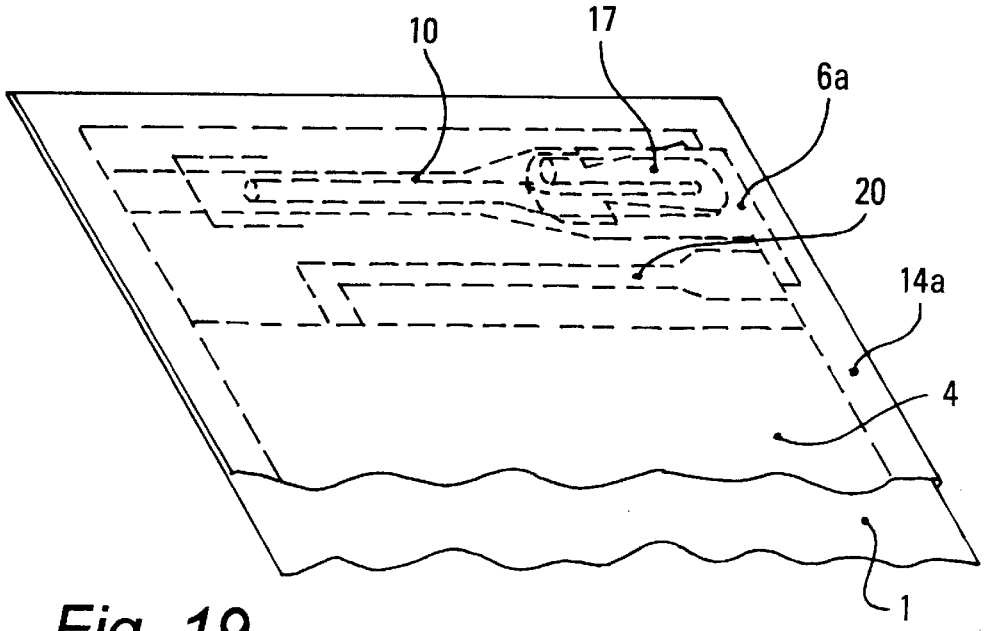
Figure 20:
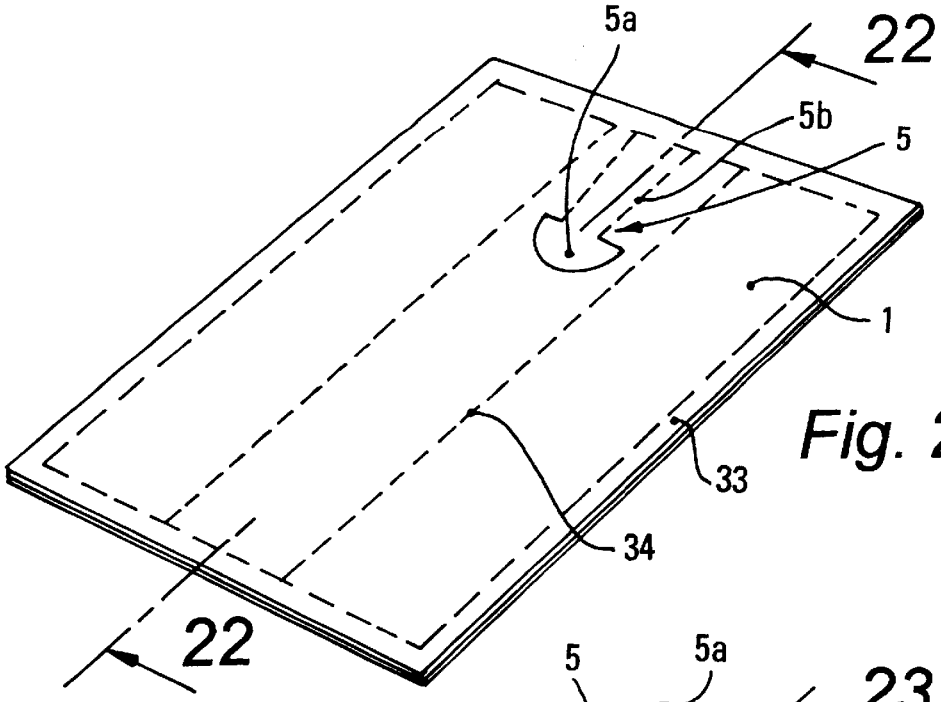
FIG. 20 is a perspective view of another alternative form, in the sealed position.

The next operation consists in inserting a folded drinking straw 17 into the passage 10 and in inserting a filling lance 23 into the passage 20. Once filling is over, the ends of the passages 10 and 20 are sealed by welding the edge of the bag in that part of the width which has been left free by the sparing lacquer 6*a* as illustrated in FIG. 19.

This bag can then be used like the bag described earlier, by tearing back the tab 5 giving access to the drinking straw 17 and to the dispensing passage 10.

Of course, it is also possible not to place a drinking straw in the passage 10, in which case the outer edge of this passage may be sealed when the edge of the bag is welded up and only that end of the second passage 20 which is adjacent to this edge left open.

All the embodiments described hitherto relate to bags with valves. Now, it would seem that the use of a tab also offers a great advantage for containers for packaging liquid which are sealed by a cap welded or bonded around an opening formed through the internal wall of the container.

The leaktight container illustrated by FIGS. 20 to 23 is shown empty and includes two sheets 1, 32 of monolayer or multilayer plastic such as polystyrene, polypropylene, polyethylene or polyamide, coming from two endless strips of the order of 100 $\mu$m thick, welded edge to edge along their entire periphery 33, then cut transversely in the direction of travel of the strips once the container is finished. A strip 34 made of a material of the same type, but which is preferably thinner, for example of the order of 40 $\mu$m is arranged between the sheets 1 and 32 and is fixed against the inner face of the sheet 1. This sheet 1 has a precut tab 5, a free end 5*a* of which constitutes an element for holding on to this tab 5, while the body 5*b* of this tab is welded to the strip 34.

Figure 21:
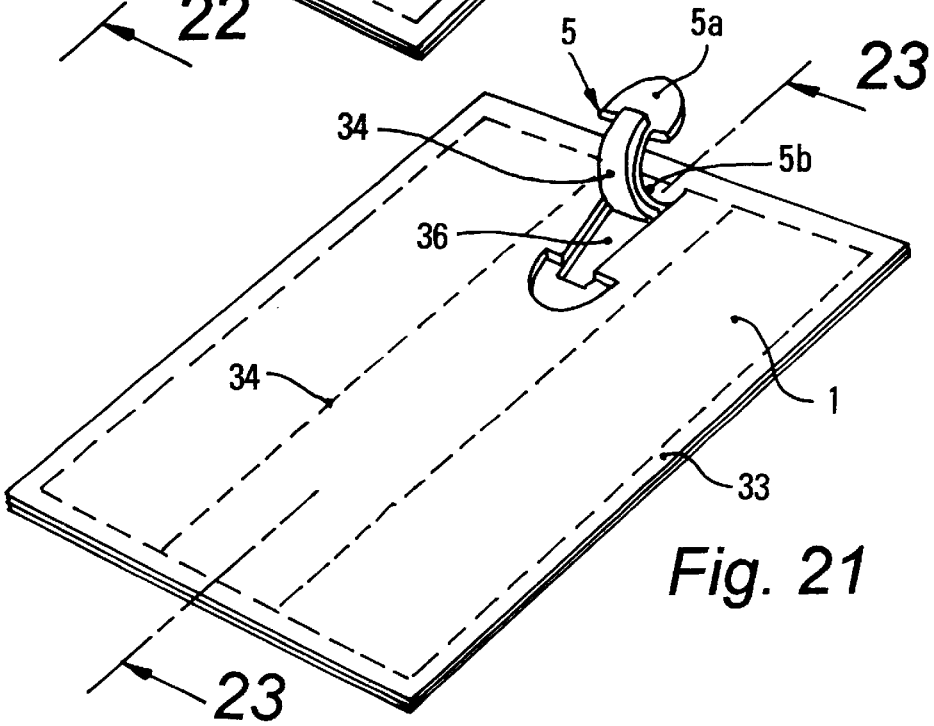
FIG. 21 is a view similar to FIG. 20, in the open position.
Figure 22:
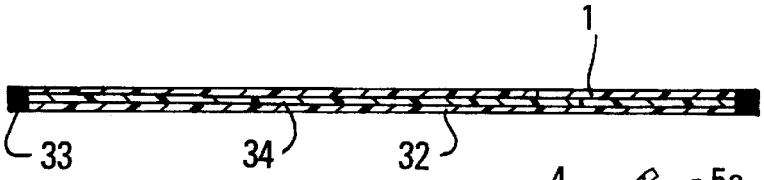
FIG. 22 is a section on XXII—XXII of FIG. 20.
Figure 23:
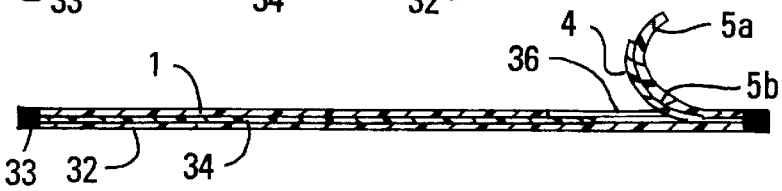
FIG. 23 is a section on XXIII—XXIII of FIG. 21.

By grasping hold of this end 5*a,* to pull the tab 5 away from the strip 1 from which it is cut, the body 5*b* which is welded to the strip 34 tears this strip as illustrated by FIGS. 21 and 23, leaving an opening 36 which gives access to the inside of the container and therefore allows the liquid packaged therein to be got out. When this liquid is a drink, a drinking straw may be inserted through the opening 36 and the liquid sucked out. When it is an ecologically-friendly refill, for example, the contents may be poured out of the container.

Although the essential advantage of the present invention is associated with flexible-walled leaktight containers of the bag type, the invention could also be applied to other types of leaktight containers for packaging liquid. Of course the invention is not in any way limited to the fact that the membrane fixed against the inner face of the wall of the container consists of a strip passing across the length or width of the container, the use of a strip of this type is advantageous because it allows the container according to the invention to be produced continuously from materials in strip form. The entire surface area of the strip 34 need not necessarily be welded to the inner face of the wall 1 of the bag. In actual fact, all that is required is for it to be welded to the body 5*b* of the tab, and for the unwelded portion of the membrane 34 adjacent to the holding end 5*a* of the tab 5 to be isolated from the inside of the bag by a leaktight connection so as to prevent the liquid being able to get out until that part of the membrane 34 which is welded to the body 5*b* of the tab 5 has been torn.

Figure 24:
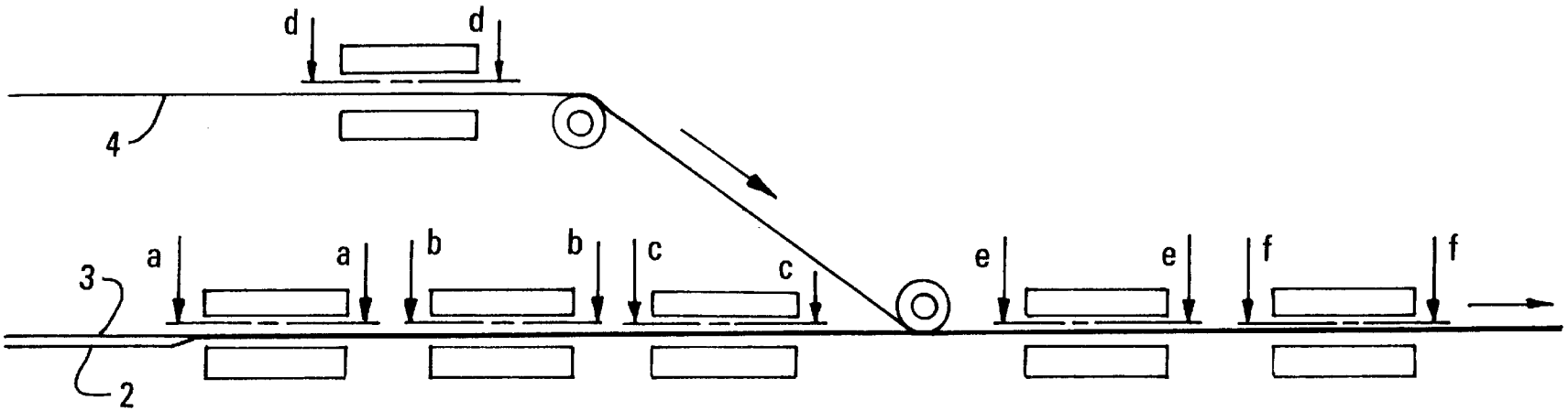
FIG. 24 is a part elevation of an alternative form of the manufacturing process of FIG. 1.
Figure 25:
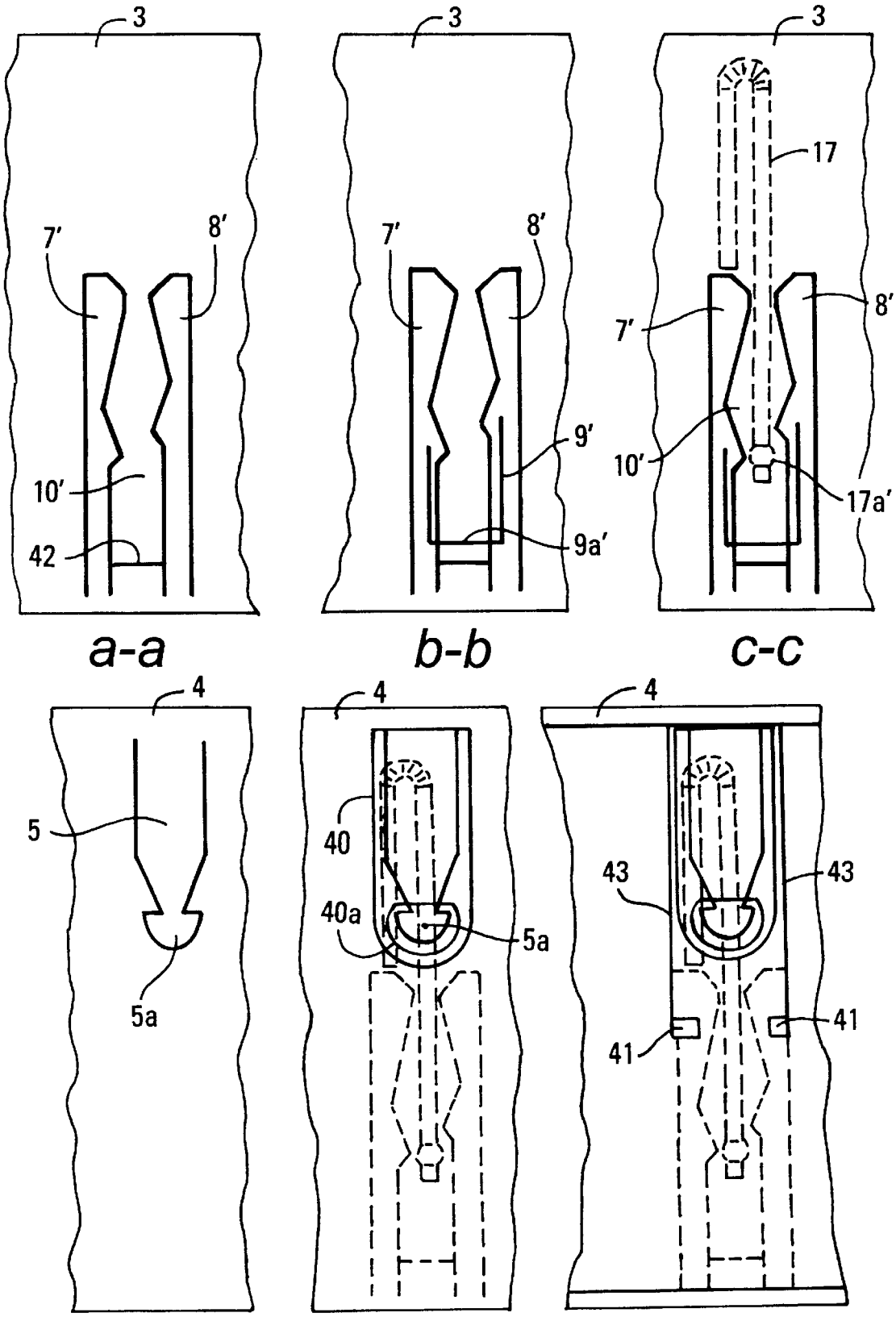
FIG. 25 is a section illustrating the successive stages in the manufacturing process of FIG. 24, on a—a, b—b, c—c, d—d, e—e and f—f.

FIGS. 24 and 25 illustrate not only an alternative form of the method of FIGS. 1 to 7, but also an alternative form of the valve formed between the sheets 2 and 3 arranged between the sheets 1 and 4 forming the bag. In this alternative form, the sheet 1 has not been represented, but it is of course there.

The first operation carried out in FIG. 24 is illustrated by section a—a of FIG. 25 and corresponds to the weld 7', 8' delimiting the passage 10' of the valve. As may be seen, this passage does not have parallel edges, and the purposes and functions of the variations in cross-section thus given to the passage 10 will be explained later. A transverse weld 42 is formed close to one end of the passage 10' the utility of this weld will be explained later.

The next operation consists in making the cut 9', 9'*a* intended to make this passage 10' communicate with the outside. This cut 9' has the shape of a U, the two arms of which are of unequal length. As can be seen, this lack of symmetry of the arms of the U-shaped cut 9' coincides with the lack of symmetry of the narrowing at the middle of the passage 10'. This lack of symmetry of the passage 10' and of the cut 9' has been shown to improve the sealing of the valve, that is to say of that part of the passage 10' which extends from the asymmetric narrowing of this passage and the cut 9', 9'*a*.

During the operation illustrated by the next section c—c, a drinking straw 17' is inserted into the passage 10'. The diameter of this drinking straw is such that it corresponds substantially to the narrowing formed at the entry of the passage 10'. This means that the drinking straw seals against the inlet end of the passage 10', which means that liquid which may have flowed between the passage 10' and the drinking straw 17' during the opening of the valve is prevented from leaving this passage 10'. It may also be noted that the end of the drinking straw 17' inserted into the passage 10' has a bulge 17'*a* which prevents the drinking straw 17' from coming out of the passage 10', this bulge resting against the narrowing situated at the entry to the passage 10'. Furthermore, the transverse weld 42 limits the movement of the drinking straw 17' in the passage 10'.

The operation illustrated by section d—d is carried out in parallel on the sheet 4 forming one of the walls of the bag. It consists in cutting out the tab 5.

Between the operation (c—c) of inserting the drinking straw 17', and the next operation d—d, the sheet 4 joins the other two sheets 2, 3 and a non-weldable sheet (not represented) is inserted between the drinking straw and the sheet 3 adjacent to the sheet 4. This means that the weld 40 made in operation e—e welds together only the sheets 3 and 4 and the opening 40*a* leaves the end 5*a* of the tab 5 free, the rest of this tab being welded to the sheet 4.

The last operation consists in making two spot welds 41 between the welds 7', 8' forming the passage 10' and the wall 4 of the bag as well as two parallel weld lines 43, the spacing of which corresponds to that of the welds 7', 8' of the passage 10'. These welds 43 attach the valve formed by the passage 10' to the opposite edge of the sheets 2, 3 and 4. It 43 thus delimit [sic] the width of the housing accommodating the folded-over part of the drinking straw 17'. As for the spot welds 41, they prevent the sheets 2, 3 from following the drinking straw 17' when the bulge 17'*a* is brought up against the narrowing situated at the entry to the passage 10', allowing the valve to close.

What is claimed is:

1. A leaktight container comprising a container fitted with a valve which lies inside the container formed between two flexible sheets extending from one edge of the container to another edge of the container wherein said one edge and said another edge are joined to the two flexible sheets which are further connected together along two non-converging connection lines whereby when the two flexible sheets are parted, a passage is delimited between the two flexible sheets, wherein the two nonconverging connection lines extend from said one edge of the container to said another edge of the container, wherein a portion of one of the two flexible sheets, which lies between the two non-converging connection lines is fixed to a tab cut in an adjacent wall of the container and attached to said adjacent wall by one tab end, and another tab end comprising a free tab end so as to form means for grasping; a leaktight connection between one of the two flexible sheets and the adjacent wall of the container extending around a periphery of the tab, said tab being adapted to break a portion of said one sheet which is fixed to said tab by pulling on said free tab end, in order to place the passage in communication from inside to outside the container, a cut being made through at least one of the two flexible sheets between the non-converging connection lines, said cut being distant from said portion of the at least one of the two flexible sheets which is fixed to the tab and serving to place said passage in communication with the inside of the container.

2. The leaktight container according to claim 1, wherein part of said tab attached to said wall of said leaktight container is adjacent to a weld joining together two walls of said leaktight container.

3. The leaktight container according to claim 1, wherein said passage formed by the said two non-converging connection lines comprises a widened part adjacent to an end of said passage, a wall portion of which is integral with said tab, said widened part serving to accommodate a folded-over end of a dispensing pipe for dispensing a liquid packaged in said leaktight container, said widened part acting as a stop for preventing said dispensing pipe from entering said passage by more than a given length when the dispensing pipe is folded over.

4. The leaktight container according to claim 1, comprising a strip of material more rigid than said walls of said leaktight container attached to said leaktight container and integral with an outer face of said tab to allow said passage to be opened when said strip is pull outwardly from said leaktight container.

5. The leaktight container according to claim 4, wherein said strip of material has score lines arranged to form a pipe for insertion into said passage to open the valve and allow liquid contained in the said leaktight container to pass through said pipe.

6. The leaktight container according to claim 1, wherein said two non-converging lines extend parallel to one edge of said bag.

7. The leaktight container according to claim 1, wherein a cross-section of said passage has a narrowing, the cross-section of which corresponds substantially to a cross-section of a dispensing pipe to be introduced through said passage.

8. The leaktight container according to claim 7, wherein said narrowing of said cross-section of the said passage comprises a stop for interacting with the end of a folded over end of a dispensing pipe to be introduced through said passage.

9. A leaktight container, comprising:

a first sheet having an internal and an external face defined by a top edge, a bottom edge, a first side edge, and a second side edge, said first sheet having a predefined tab cut at a predetermined location in said first sheet face, said tab comprising a free tab end so as to form a means for grasping;

a first flexible strip;

a second flexible strip disposed over said first flexible strip, said second flexible strip joined to said first flexible strip along two substantially parallel lines by a first leaktight connection thereby delimiting a passage between adjacent walls of said first and second flexible strips, said joined first and second flexible strips disposed over a portion of said first sheet such that a portion of said passage is disposed over said tab in said first sheet face, said first flexible strip joined to said internal face of said first sheet near said top edge of said first sheet by a second leaktight connection extending from said first edge to said second edge of said first sheet, and further wherein said first flexible strip is joined to said internal face of said first sheet by a third leaktight connection extending around a periphery of said tab in said first sheet, and further wherein a portion of said first sheet disposed between the two substantially parallel lines which form said first leaktight connection defining said passage is fixed to said internal face of said first sheet a said tab, said tab being adapted to break a portion of said first flexible strip which is fixed to said tab by pulling on said free tab end;

a second sheet having an internal and an external face defined by a top edge, a bottom edge, a first side edge, and a second side edge, said second sheet disposed over said first sheet including said portion of said first sheet having said joined first and second flexible strips disposed thereon, such that said joined first and second flexible strips are disposed between said internal faces of said first and second sheets, said second sheet being joined to said first sheet by a leaktight connection along said top edges, said bottom edges, said first side edges, and said second side edges of said first and second sheets thereby defining an interior volume within the leaktight container;

a cut disposed in a portion of said passage distant from said portion of said passage disposed over said tab, said cut placing said passage in communication with said interior volume of the leaktight container.

* * * * *

UNITED STATES PATENT AND TRADEMARK OFFICE

CERTIFICATE OF CORRECTION

PATENT NO. : 6,334,711 B1
DATED : January 1, 2002
INVENTOR(S) : Eric Risgalla et al.

It is certified that error appears in the above-identified patent and that said Letters Patent is hereby corrected as shown below:

Title page,
Item [30], Foreign Application Priority Data, please insert -- PCT/IB96/00288 filed on April 4, 1996 --.

Signed and Sealed this

Twenty-third Day of April, 2002

*Attest:*

*Attesting Officer*

JAMES E. ROGAN
*Director of the United States Patent and Trademark Office*